US006481695B1

(12) United States Patent
Fuller

(10) Patent No.: US 6,481,695 B1
(45) Date of Patent: Nov. 19, 2002

(54) SNATCH BLOCK HOOK BOLT ASSEMBLY

(75) Inventor: Ray Duane Fuller, Owasso, OK (US)

(73) Assignee: The Crosby Group, Inc., Tulsa, OK (US)

( * ) Notice: Subject to any disclaimer, the term of this patent is extended or adjusted under 35 U.S.C. 154(b) by 0 days.

(21) Appl. No.: 09/904,694

(22) Filed: Jul. 13, 2001

(51) Int. Cl.[7] ..... B66D 3/04
(52) U.S. Cl. ..... 254/405
(58) Field of Search ..... 254/390, 405, 254/406, 411, 412, 415, 416

(56) References Cited

U.S. PATENT DOCUMENTS

| | | | | | |
|---|---|---|---|---|---|
| 430,519 | A | * | 6/1890 | Ferrall | 254/405 |
| 2,366,636 | A | | 1/1945 | McKissick et al. | 254/193 |
| 2,449,703 | A | * | 9/1948 | Johnson | 254/406 |
| 2,464,451 | A | * | 3/1949 | Keeney | 254/405 |
| 2,474,433 | A | | 6/1949 | McKissick | 254/193 |
| 2,555,059 | A | * | 5/1951 | Schrader | 254/406 |
| 2,584,783 | A | * | 2/1952 | Berg | 254/402 |
| 2,649,282 | A | | 8/1953 | Fate, Jr. | 254/193 |
| 3,982,733 | A | * | 9/1976 | Orme | 254/335 |
| 3,999,739 | A | * | 12/1976 | Vick et al. | 254/390 |
| 4,562,976 | A | * | 1/1986 | Ban | 242/231 |
| 4,614,332 | A | | 9/1986 | Wilson | 254/405 |
| 4,940,375 | A | * | 7/1990 | Marvell et al. | 29/432.2 |
| 5,096,349 | A | * | 3/1992 | Landy et al. | 411/108 |
| 6,263,999 | B1 | * | 7/2001 | Atkinson et al. | 182/5 |

* cited by examiner

*Primary Examiner*—Emmanuel M. Marcelo
(74) *Attorney, Agent, or Firm*—Head, Johnson & Kachigian

(57) ABSTRACT

The present invention relates to an improvement in the construction of a snatch block hook bolt assembly which supports the trunnion or becket to which a hook may be attached. A snatch block having a first fixed side plate having a first aperture and a second side swinging side plate having a second aperture and a sheave rotatably held between the first fixed side plate and the second swinging side plate, comprising a spool with a passage there through and an alignment means for positioning said spool concentrically with said first aperture of said first fixed side plate; a threaded nut with an alignment means for positioning said nut concentrically with said second aperture of said second side swinging side plate; and a threaded bolt having a length extendable through said first aperture in said first fixed side plate, through said spool passage, and threadably communicating with said threaded nut.

14 Claims, 3 Drawing Sheets

SNATCH BLOCK HOOK BOLT ASSEMBLY

BACKGROUND OF THE INVENTION

1. Field of the Invention

The invention relates to improvements in snatch blocks with two side plates, one of which is called the swing plate and is pivoted about the sheave bolt between the two side plates. More particularly, the present invention relates to an improvement in the construction of the snatch block hook bolt assembly which supports the trunnion or becket to which a hook or other fitting may be attached.

2. Prior Art

Snatch blocks are typically composed of two spaced apart parallel side plates, one of which is called the swing plate and is pivoted about the sheave pin which is between the two side plates. This construction is generally to provide access to the sheave for stringing rope or cable to the sheave.

In the prior art, the first side plate and the second or swing side plate are normally of about the same configuration. A sheave supporting means for supporting a wire rope or line is supported by and held between the two side plates and is generally located at the top of the snatch block. The sheave support means is typically a sheave pin.

The hook bolt assembly is spaced from the sheave supporting means. The hook bolt is provided between the plates such that a trunnion or becket may be supported and to which a hook or other fitting may be attached.

Typically, when the snatch block is assembled for use, a hole in each side plate's lower portions are aligned. A spool member is attached to one of the side plates and has a hole through the spool member which is slightly larger than the diameter of the hook bolt which extends through the holes in the two side plates. The periphery of the hole of the spool adjacent the side toward the sheave supporting means is aligned with the periphery of the holes in the side plates. This permits the lower bolt to pass through and support the spool member. A hook with a trunnion or becket is typically supported by the spool.

It is known to provide a spool on the hook bolt such that it is welded to one of the plates and the holes in the two plates for the hook bolt are preferably aligned with the hole of the spool. The hook bolt which extends through the spool member is threaded at one end which extends into the swing plate for mating.

Typically, a hook bolt goes through the hole in the first plate, through the spool and is fastened to a nut positioned in or on the swing plate to hold the swing plate in position. It is known to weld a nut for mating the bolt to the swing plate or to provide threads in the hole of the swing plate for such.

Furthermore, it is known at the butt of the threads of the hook bolt to provide a groove into which a C-spring is placed. When the snatch block is completely made up, this C-spring is positioned inside the swinging side plate. When the bolt or side plate is to be removed or opened so that restringing can occur, the bolt is screwed out of the swinging plate but the C-spring abuts the shoulder of the hole of the fixed plate and prevents the bolt from falling out.

Snatch blocks in general are well known. For a discussion of the prior art and the configurations of typical snatch blocks, see U.S. Pat. No. 2,366,636 issued Jan. 2, 1945 to W. H. McKissick et al., U.S. Pat. No. 2,474,433 issued Jun. 28, 1949 to W. H. McKissick, and U.S. Pat. No. 2,649,282 issued Aug. 18, 1953 to J. E. Fate, Jr. Furthermore, see U.S. Pat. No. 4,614,332 issued Sep. 30, 1986 to Wilson.

The prior art snatch block assemblies which provide a hook bolt assembly as described above sometimes suffer from the problems associated with the fabrication of mating parts in heavy duty application directed to steel and other metal components. Because of the tolerance on the mating parts, it is often difficult to align the nut and spool to the side plates.

Furthermore, it is also commonplace that the prior art nut and spool arrangements require extra time and steps in the assembly and fabrication of components due to the need of exacting tolerances of mating parts. The prior art needs continuous monitoring of tolerances on the mating parts and close attention must be paid to changing the line up pins on the welded fixtures. If such tolerances and changing the line up pins are not adhered to properly, the components must be replaced in order to assemble and fabricate a fully functional snatch block.

Furthermore, in the prior art, at least one of the side plate holes needed a chamfered portion for compressing a retaining C-clip. This required specialized production of the holes as opposed to a simple punch or drilling out a hole in the side plate.

Therefore, there is a need and a desire to provide a new and improved snatch block hook bolt assembly that keeps components in line during assembly and fabrication. Furthermore, there is a need and a desire to reduce scrapping of components while providing a functional snatch block.

SUMMARY OF THE INVENTION

The present invention is a new and improved snatch block hook bolt assembly which provides a lip or protuberance to a spool such as but not limited to the side in contact with the first or fixed plate such that the lip or protuberance is accommodated in the alignment hole of the first or fixed plate. It is further contemplated that the retaining nut attached to the second or swing plate may also have a lip or protuberance that is accommodated in the alignment hole of the second or swing plate.

The invention of providing a lip or protuberance on the nut and spool keep all the components of the hook bolt assembly in line during fabrication and assembly and provide for a new and improved snatch block and assembling of same. It is still further provided that a C-ring will now engage into the lip of the nut and keep the lower bolt from backing off because the lip and the threads will be concentric. The C-ring will also catch in the spool due to a stepped feature of the spool. Because the spool will align with the nut, grinding will be eliminated.

In this respect, before explaining at least one embodiment of the invention in detail, it is to be understood that the invention is not limited in this application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved snatch block hook bolt assembly that provides a means of aligning components of the hook bolt during fabrication.

It is a further object of the present invention to provide a new and improved snatch block hook bolt assembly which is of a more durable and reliable construction than that of the prior art with such features as concentric alignment of components.

An even further object of the present invention is to provide a new and improved snatch block hook bolt assembly which provides for catching a c-ring of the hook bolt or lower bolt of the hook bolt assembly in the spool and thus eliminate the need for chamfering the holes in the side plates.

Still another object of the present invention is to provide a new and improved snatch block hook bolt assembly which is susceptible of a lower cost of manufacture with regard to both materials and labor, which accordingly is then susceptible of lower prices of sale to the consuming industry, thereby making such economically available to the end user.

Another object of the present invention is to provide a new and improved snatch block hook bolt assembly which provides some of the advantages of the prior art, while simultaneously overcoming the disadvantages normally associated therewith.

Yet another object of the present invention is to provide a new and improved snatch block hook bolt assembly which has a more efficient use of materials and hence reduces reworking and the scrapping of components.

Still yet another object of the present invention is to provide a new and improved snatch block hook bolt assembly with a lip or protuberance on a retaining nut for aligning in the second or swinging plate.

It is a further object of the present invention to provide a new and improved snatch block hook bolt assembly which provides a lip or protuberance on a spool of a hook bolt assembly for aligning in the first or fixed plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

DETAILED DESCRIPTION OF THE PREFERRED EMBODIMENT

Figure 1:
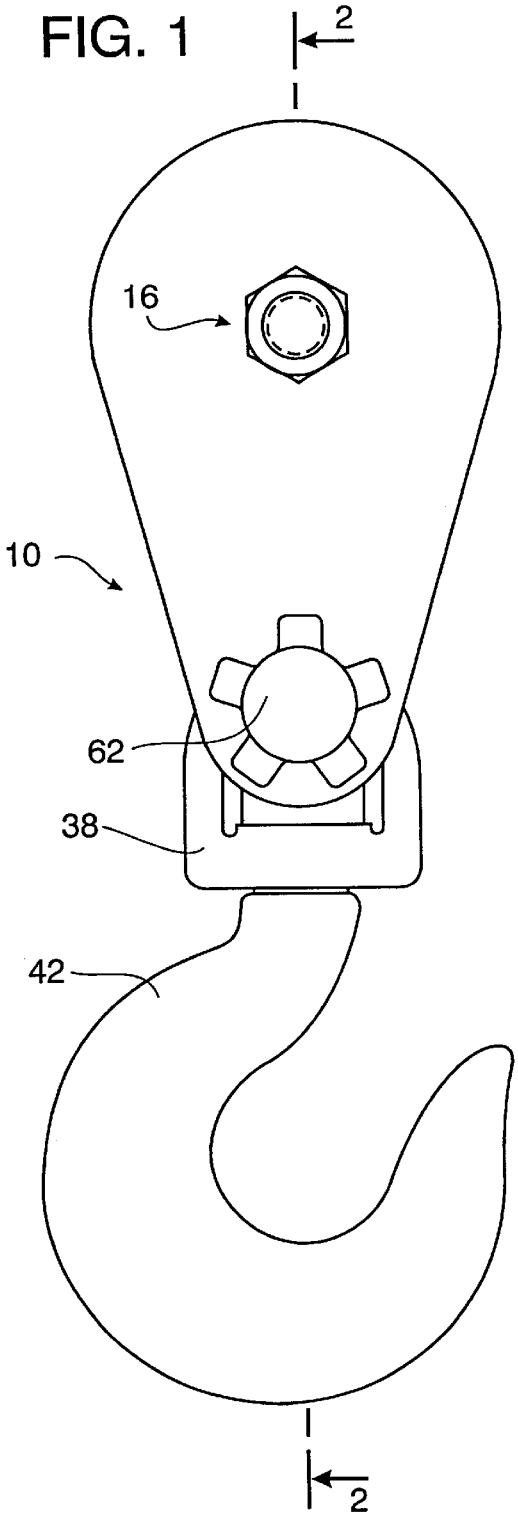
FIG. 1 is a side elevation of one form of the snatch block in closed position constructed in accordance with a preferred embodiment of the invention.
Figure 2:
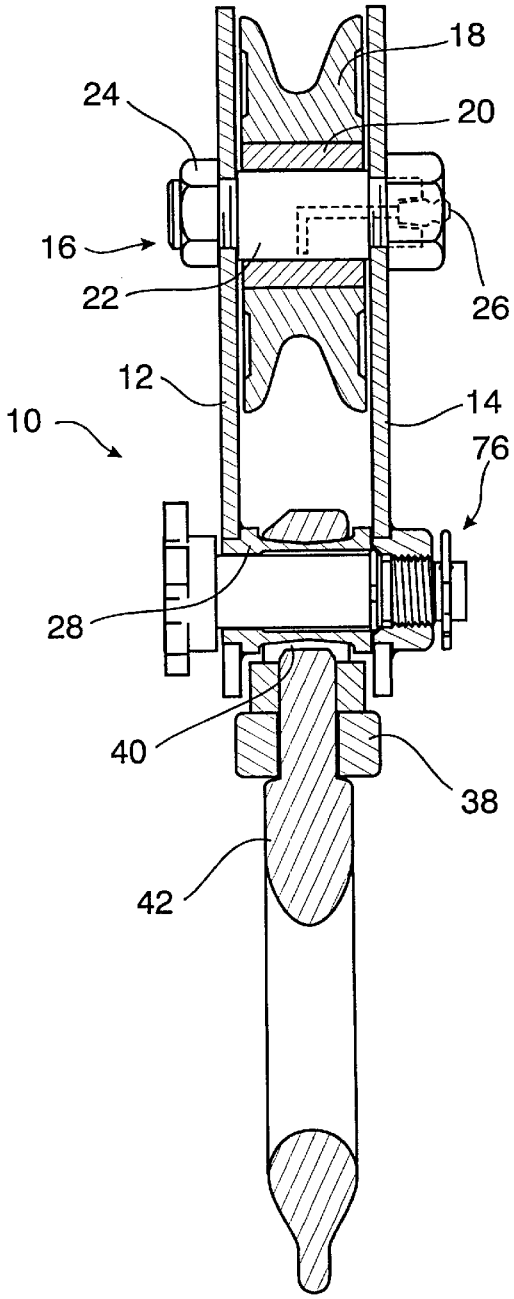
FIG. 2 is a sectional view taken along line 2—2 of FIG. 1.

Referring now to the drawings, and specifically FIGS. 1 and 2 in particular, reference numeral 10 generally designates a preferred embodiment of a new and improved snatch block assembly with a first or fixed side plate 12 and a second or swing side plate 14. Support means 16 holds a first or fixed side plate 12 and a second or swing side plate 14 apart and also supports a sheave member 18 over which the cable or rope (not depicted) will be threaded.

Sheave member 18 is supported on a bearing 20 surrounding center pin 22 extending between the outside of first or fixed side plate 12 and the second or swing side plate 14 and is held in position by a nut 24 threadably connected thereon. In a preferred embodiment, optional zerk mechanism 26 (shown in outline) is also provided for inserting lubrications to bearing 20.

Spaced from the sheave 18 is a spool or tubular member 28 which is attached to first side or fixed plate 12 such as, but not limited to, weld 30. A hook bolt assembly is shown exploded in FIG. 3 and assembled in FIG. 4. The spool or tubular member 28 is provided with a first shoulder or flange 32 and a second end flange 34 with a cradle 36 therebetween which supports becket or trunnion 38. A nut 40 supports the swivel hook 42 from the trunnion 38.

In a preferred embodiment of the invention 10, spool 28 further includes first alignment mechanism 44 such as, but not limited to, lip or protuberance 46 for communicating with first or fixed plate 12 hole 48. Typically, hole 48 is punched or drilled into first or fixed plate 12 and has a slightly larger diameter than spool lip 46 such that lip 46 slip fits inside hole 48. In a preferred embodiment, lip 46 fits snugly in hole 48 for attaching with weld 30.

A threaded nut 50 is also provided for attachment to second or swing plate 14 hole 52 such as but not limited to weld 54. Another preferred embodiment of invention 10 may further include second alignment means 56 for nut 50 such as but not limited to lip or protuberance 58 for communicating with second or swing plate 14 hole 52. Also typically, hole 52 is punched or drilled into second or swing plate 14 and has a slightly larger diameter than nut 50 lip 58 such that lip 58 slip fits inside hole 52. In a preferred embodiment, lip 46 fits snugly in hole 52 for attaching with weld 54.

Figure 3:
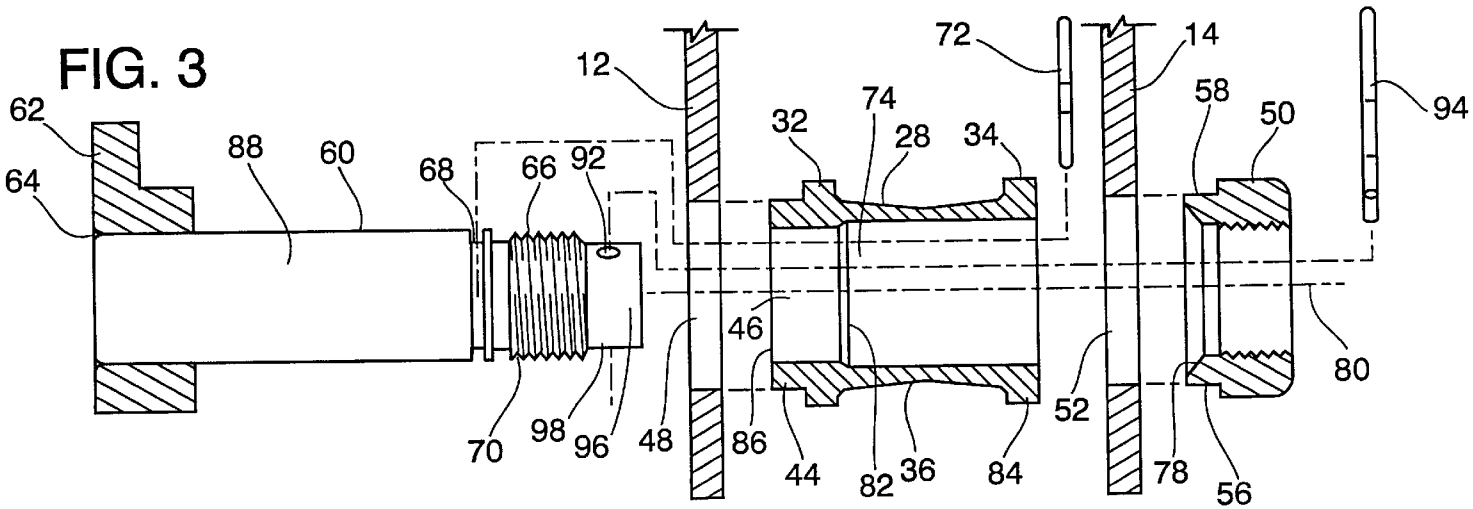
FIG. 3 is an exploded view of the side plates, spool and bolt constructed in accordance with a preferred embodiment of the invention.

Once again directing attention to the drawings and FIG. 3 in particular, bolt 60 is provided with a head 62 which may be attached to bolt 60 by weld 64. The other end of the bolt 60 is provided with a thread 66 and a groove or recess 68 at the butt 70 of the threads 66 into which a C-spring 72 is placed.

The bolt 60 is generally aligned to be inserted through hole 48 of first or fixed side plate 12, the passage 74 through spool 28 to hole 52 of second or swing plate 14 and connected to the threaded nut 50.

Figure 4:
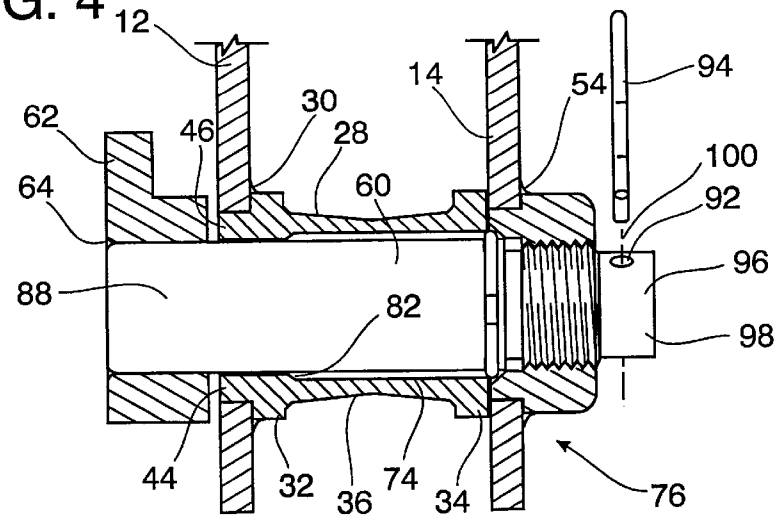
FIG. 4 is an assembled view of the parts of FIG. 3 in accordance with a preferred embodiment of the invention.

These assembled parts are generally shown in FIG. 4 in which the bolt 60 is inserted and is connected to threaded nut 50. This secures first or fixed side plate 12 and a second or swing side plate 14 in a locked position 76. Spool 28 is attached to first or fixed plate 12. The passage 74 in spool 28 is slightly smaller than holes 48 and 52.

In a preferred embodiment, threaded nut 50 lip 58 further includes a chamfered surface 78 for communicating with C-spring 72. It is contemplated that as bolt 60 is continued to be tightened, the C-spring 72 is forced against the chamfered surface 78 and is compressed sufficiently so that it can enter the threaded nut 50 and be in frictional contact such that a friction is created against movement. This compression of C-spring 72 and the friction maintains bolt 60 in a generally full made up position. It is still further contemplated that to tighten the bolt 60, use of a hammer may be necessary.

In the manufacture, fabrication or assembly of snatch block 10 it is contemplated that spool 28 lip 46 and nut 50 lip 58 ensure alignment and same center lines 80 of spool 28 and nut 50 and afford an interference fit of C-spring 72 to nut 50, before welding spool 28 to first or fixed plate 12 and nut 50 to second or swing plate 14.

With groove 68 of bolt 60 and threaded nut 50, the C-spring 72 will generally exert an even drag to resist unintentional unscrewing of bolt 60 and afford retention of C-spring 72 at spool 28 shoulder 82 of lip 46. It is contemplated that lip 46 distill end 82 may be of a slightly smaller diameter than that of the spool 28 passage 74 such that C-spring 72 is retained from complete removal from passage 74. In a preferred embodiment, spool 28 passage 74 is generally stepped from spool 28 first end 84 to spool 28 second end 86.

It is still further contemplated that the hook bolt assembly 88 which generally comprises bolt 60 first or fixed plate 12 hole 48, spool 28, second or swing plate 14, and nut 50 are generally aligned. In the preferred embodiment, the concentric alignment of bolt 60 to spool 28 and nut 50 is desired as opposed to eccentric alignment of bolt 60 to spool 28 and nut 50 for purposes of mating.

Figure 5:
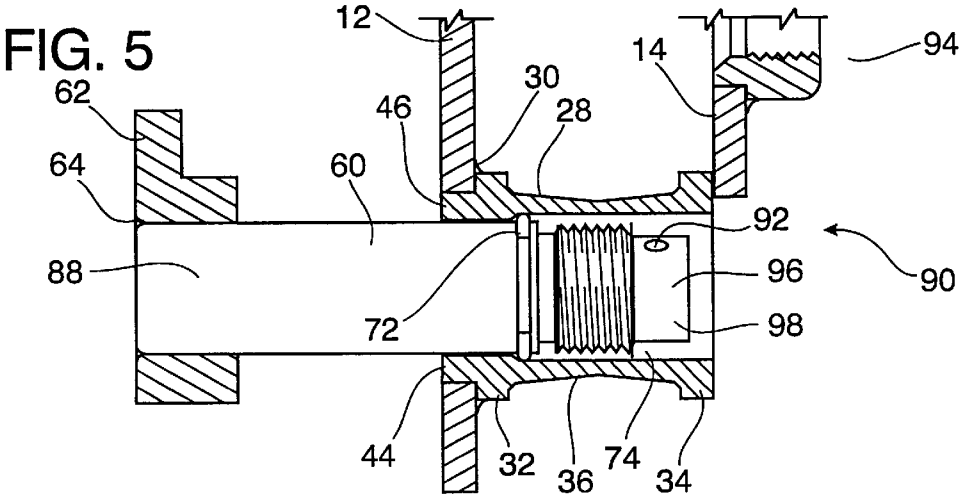
FIG. 5 shows the swing side plate swung free and the bolt in the open but retained position in accordance with a preferred embodiment of the invention.

Once again referring to the drawings and FIG. 5 in particular, when it is desired to replace a rope, for example, bolt head 62 is turned to loosen bolt 60 from second or swing plate 14 until it generally reaches position 90. Second or swing plate 14 is free to swing to one side to permit the string of rope through the snatch block 10. It is contemplated that a hammer may be used to loosen head 62.

It is further contemplated that bolt 60 may further include an aperture 92 for the placement of a retention clip 94 such that may be placed on the end 96 of bolt 60 when hook bolt assembly 88 is made up. Bolt 60 end 96 may further include a non-threaded portion 98 for the general placement of aperture 92. Retention clip 94 is generally in place when bolt 60 is in position 100 as depicted in the preferred embodiment of FIG. 4.

As can be seen in FIG. 5, the C-spring 72 has expanded and contacted spool 28 lip 46. This prevents the bolt 60 from falling out of the first or fixed plate 12 hole 48. Once the stringing of the rope has been completed, second or swing plate 14 is swung back into a closed position and bolt 60 is then inserted into threaded nut 50.

Figure 6:
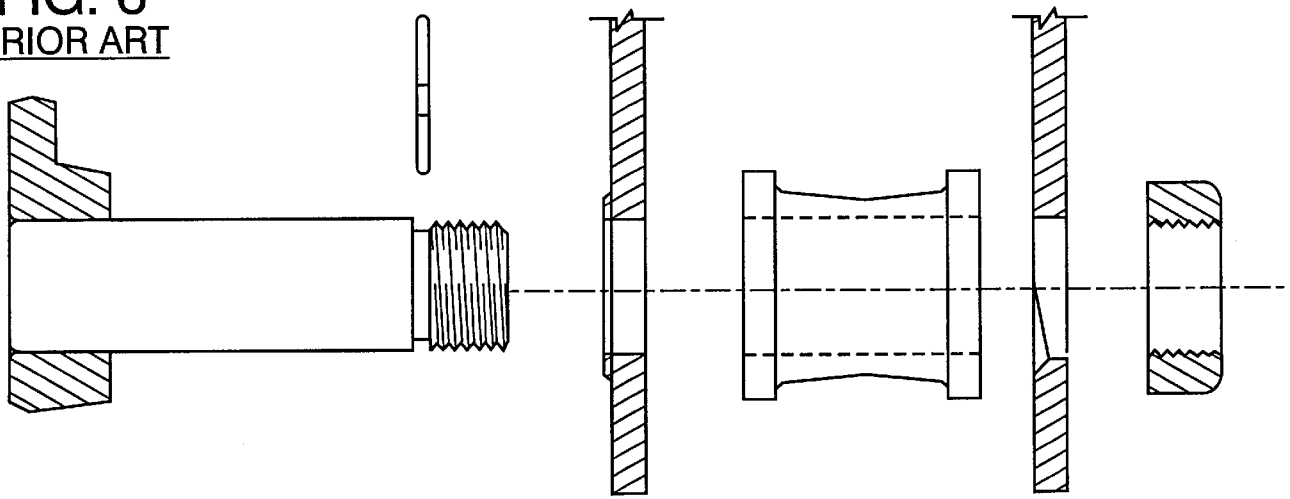
FIG. 6 PRIOR ART
FIG. 6 is an illustration of the prior art in an exploded view.

For purposes of illustration, FIG. 6 is provided which generally depicts the prior art as depicted in U.S. Pat. No. 4,614,332 issued Sep. 30, 1986 to Wilson. Of note, the spool depicted does not have a lip for communicating with a hole in the side plate nor does the nut depicted have a lip for communication with the hole in the other side plate. Furthermore, one side plate depicted features a chamfered edge.

It will be apparent to those skilled in the art that various modifications and variations can be made in the construction, configuration, and/or operation of the present invention without departing from the scope or spirit of the invention. For example, in the embodiments mentioned above, it is contemplated that one or more of the components are preferably constructed from metal such as but not limited to steel. The material used, however, may be something other than metal without departing from the intended scope of the invention.

Whereas, the present invention has been described in relation to the drawings attached hereto, it should also be understood that changes and further modifications may be made in the construction and the operation of various components, elements and assemblies described herein or in the steps or the sequence of steps of the methods described herein within the spirit and scope of the invention as defined in the following claims.

What is claimed is:

1. A snatch block including a first fixed side plate having a first aperture, a second swinging side plate having a second aperture, and a sheave rotatably held between the first fixed side plate and the second swinging side plate, the improvement comprising:

a spool with a passage therethrough and an alignment means for positioning said spool concentrically with said first aperture of said first fixed side plate; and a threaded bolt having a length extendable through said first aperture in said first fixed side plate, through said spool passage, and said second aperture of said second side swinging side plate.

2. The snatch block of claim 1 wherein said spool alignment means is a lip for communicatively inserting with said first aperture of said first fixed side plate.

3. The snatch block of claim 2 wherein said spool passage further includes a step.

4. The snatch block of claim 1 wherein said spool alignment means is welded to said first fixed side plate.

5. A snatch block having a first fixed side plate having a first aperture and a second swinging side plate having a second aperture and a sheave rotatably held between the first fixed side plate and the second swinging side plate, comprising:

a spool with a passage therethrough aligned between said first aperture of said first fixed side plate and said second aperture of said second side swinging side plate;

a threaded bolt having a length extendable through said first aperture in said first fixed side plate, through said spool passage, and said second aperture of said second side swinging side plate; and a threaded nut having an alignment mechanism for positioning said nut concentrically with said second aperture of said second side swinging side plate and which threadably communicates with said threaded bolt.

6. The snatch block of claim 5 wherein said threaded nut alignment means is a lip for communicatively inserting with said second aperture of said second side swinging side plate.

7. The snatch block of claim 6 wherein said lip further includes a chamfered distal end.

8. The snatch block of claim 5 wherein said threaded nut alignment means is welded to said second side swinging side plate.

9. A snatch block comprising:

a first fixed side plate defining an aperture;

a second swinging side plate defining an aperture with a fixed threaded nut with an alignment means for concentrically fixing said threaded nut with said aperture;

a sheave rotatably held between said first fixed side plate and the second swinging side plate;

a spool having a passage therethrough and with an alignment means for concentrically fixing said spool with said first fixed plate aperture; and a threaded bolt extendable through said first fixed side plate aperture, said spool, said second swinging side plate aperture and communicating with said threaded nut.

10. The snatch block of claim 9 wherein said threaded bolt further includes a retaining means to retain said bolt within said spool passage.

11. The snatch block of claim 10 wherein said threaded bolt retaining means further includes a groove in said threaded bolt and a C-spring positioned in said groove.

12. The snatch block of claim 11 wherein said spool further includes a stepped portion.

13. The snatch block of claim 12 wherein said threaded nut further includes a chamfered end for compressing said threaded bolt C-spring into said threaded nut creating a frictional drag as threaded bolt extends into said threaded nut.

14. The snatch block of claim 11 wherein said bolt further defines an aperture for removably attaching with a retention clip.

* * * * *